United States Patent [19]

Czeschka

[11] Patent Number: 4,959,024

[45] Date of Patent: Sep. 25, 1990

[54] SHIELDING DEVICE FOR ELECTRIC PLUG CONNECTORS

[75] Inventor: Franz Czeschka, Rechberghausen, Fed. Rep. of Germany

[73] Assignee: ERNI Elektroapparate GmbH, Adelberg, Fed. Rep. of Germany

[21] Appl. No.: 417,524

[22] Filed: Oct. 5, 1989

[30] Foreign Application Priority Data

Oct. 7, 1988 [DE] Fed. Rep. of Germany ..... 3834182

[51] Int. Cl.[5] ..... H01R 13/648

[52] U.S. Cl. ..... 439/607

[58] Field of Search ..... 439/607-610, 439/95, 101, 65

[56] References Cited

U.S. PATENT DOCUMENTS

| | | | |
|---|---|---|---|
| 3,587,029 | 6/1971 | Knowlrs | 439/607 |
| 4,806,109 | 2/1989 | Manabe et al. | 439/607 X |
| 4,808,115 | 2/1989 | Norton et al. | 439/609 X |

*Primary Examiner*—Eugene F. Desmond

*Attorney, Agent, or Firm*—Nils H. Ljungman & Associates

[57] ABSTRACT

A shielded connector is for connecting a first board to a second board, such as printed circuit boards or the like. The shielded connector includes a first connector housing for being installed on the first board and includes first electrical contacts therein which are for being electrically connected to the first board. A second connector housing is for being installed on the second board and includes second electric contacts therein which are for being electrically connected to the second board. The first and second connector housings mate to cause the first and second electric contacts to mate. First shielding for the first electrical connector housing and the first electric contacts therein include a first shielding device at one side and a second shielding device at the other side of the first connector housing. The first and second shielding devices are respectively electrically connected to the first board. Second shielding for the second connector housing and the second electric contacts therein include a third shielding device at one side and a fourth shielding device at the other side of the second connector housing. The third and fourth shielding devices are respectively electrically connected to the second board. The first shielding device is in overlapping electrical contact with the third shielding device and the second shielding device is in overlapping electrical contact with the fourth shielding device when the first and second connector housings are mated for causing the first electric contacts to mate with the second electric contacts.

12 Claims, 1 Drawing Sheet

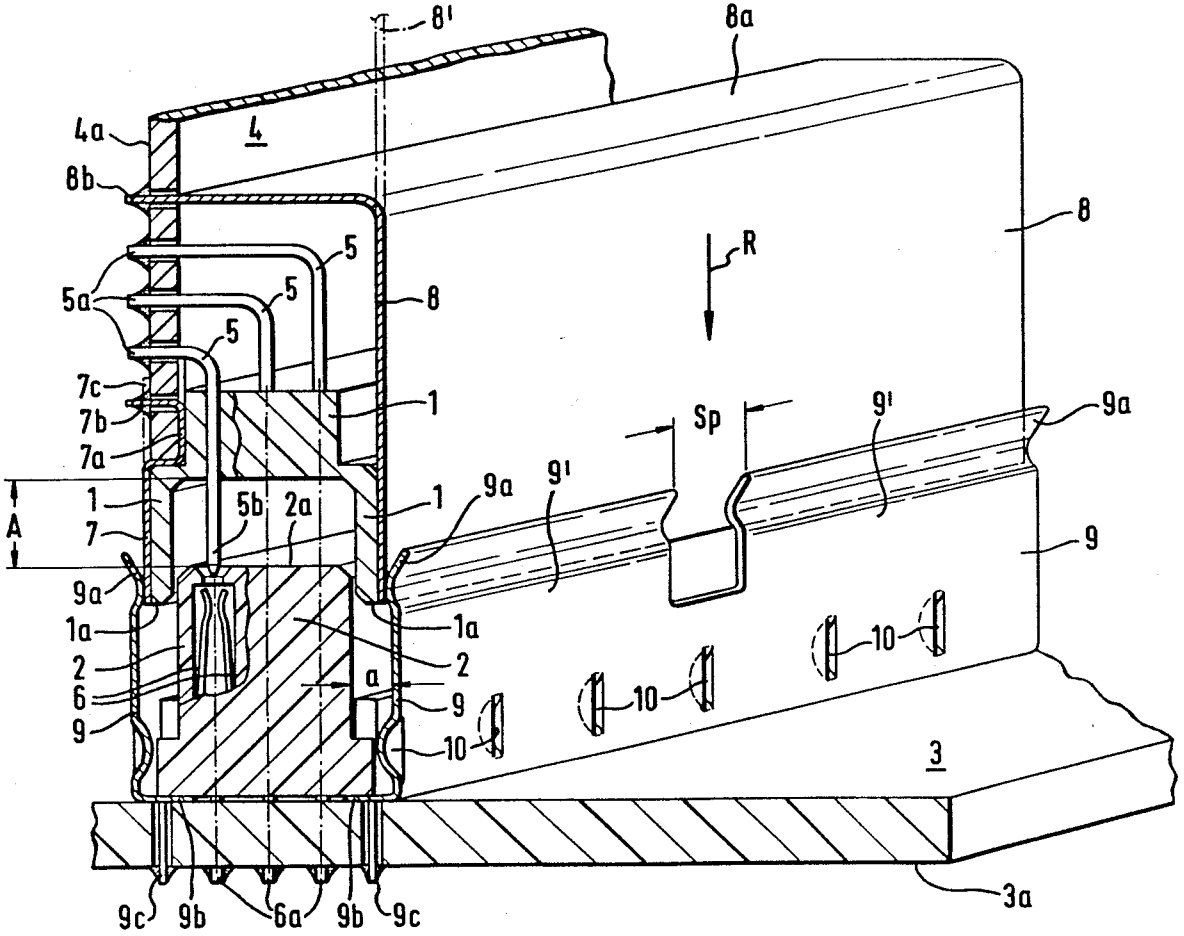
8
9a
9
3a
3
9'
10
8a
R
Sp
10
9'
9a
1a
2
9
10
8'
8
1
1
a
9c
9b
5
2a
6a
5
5b
5
9b
9c
4
4a
8b
5a
7c
7b
7a
1
7
9a
1a
2
6
9
A

SHIELDING DEVICE FOR ELECTRIC PLUG CONNECTORS

BACKGROUND OF THE INVENTION

1. Field of the Invention

The invention relates to a shielding device for electric plug connections and, more specifically, relates to so called "indirect plug connections", which are, for example, for the connection of daughter boards to a circuit board with printed circuits.

2. Description of the Prior Art

It is not uncommon for some type of shielding to be required for technical reasons for the respective prevention of radiation or infiltration of interference signals which can occur during the use of such connections. For example, such shielding may be employed for the suppression of radio frequency interference (RFI). Although some types of assembly shielding are disclosed on European Patent No. 0 025 195, as well as U.S. Pat. No. 3,895,267, there remains a need for an effective and reliable shielding device for such connections.

OBJECTS OF THE INVENTION

It is an object of the present invention to provide shielding which does not require any special housing embodiments for the terminal strips and spring contact strips of such shielded plug connections.

As a result, it is an object of the invention to utilize standardized connectors and to shield the respective modules by means of space saving auxiliary shielding devices.

SUMMARY OF THE INVENTION

These and other objects of the invention are provided in a preferred embodiment thereof including a shielded connector for connecting a first board to a second board, such as printed circuit boards or the like. The shielded connector includes a first connector housing which is for being installed on the first board and includes first electrical contacts therein which are for being electrically connected to the first board. A second connector housing which is for being installed on the second board includes second electric contacts therein which are for being electrically connected to the second board. The first connector housing is for mating with the second connector housing for causing the first electric contacts to mate with the second electric contacts. There is a first element for shielding the first electrical connector housing and the first electric contacts therein. The first elements for shielding include a first shielding device at one side of the first connector housing and a second shielding device at the other side of the first connector housing. The first shielding device and the second shielding device are respectively electrically connected to the first board. A second element is for shielding the second connector housing and the second electric contacts therein. The second element for shielding includes a third shielding device at one side of the second connector housing and a fourth shielding device at the other side of the second connector housing. The third shielding device and the fourth shielding device are respectively electrically connected to the second board. The first shielding device is for being in overlapping electrical contact with the third shielding device and the second shielding device is for being in overlapping electrical contact with the fourth shielding device when the first connector housing and the second connector housing are mated for causing the first electric contacts to mate with the second electric contacts.

The solution of the problem presented by the present innovation is written down in the claims, can be seen in the drawing and is explained further by means of the drawing.

BRIEF DESCRIPTION OF THE DRAWING

The drawing shows a perspective illustration of a cross section of a shielding device including various features of the invention.

DESCRIPTION OF THE PREFERRED EMBODIMENTS

As seen in the drawing, the illustrated shielding device is for electric connections consisting of standardized contact strips and spring contact strips, such as so-called "indirect connectors". For example, such connectors are used for the connection between a daughter board and a printed circuit board which serves as a mother board.

The preferred shielding device includes structural and design features as follows:

a. The outer surfaces of the insulation housings, including all exposed parts of the electric contact pins 5, of contact strip 1 and spring contact strip 2 which are mounted on the surface of the circuit boards 3 and 4, are, with the exception of the contact surfaces 1*a* and 2*a* preferably surrounded by electrically conductive metallic shielding devices or other conductive devices 7, 8 and 9 as required.

b. The shielding devices 7, 8 and 9 respectively have ground contacts 7*b* or 7*c*, 8*b* and 9*c* for either soldering or spade terminal connection with the backside of their respective printed circuit boards 3*a* and 4*a*.

The combination of this type of construction is characterized by the fact that the shielding devices are separate metallic beveled profiles in the shape of guide 7 with an offset 7*a* or guide 9 with a fold 9*b* or guide 8 with a hoodshaped portion 8*a*. This combination not only achieves the desired goal of being used with standardized connectors to provide the required shielding, but also makes it possible to provide a simple assembly of the shielding devices together with the entire assembly unit.

A further special detailed embodiment of this invention provides for the shielding devices 7, 7*a* and 8 to be in contact with the side surfaces of the insulating housing of terminal strip 1 in the area of contact surface 1*a*. Each shielding device 9, 9*b* is held at a plug-in distance "a" in relation to spring contact housing 2 by means of a spring travel limitation crimp 10 or the like. Additionally, the channel-like shielding devices 9 include a fold 9*b* which is practically located under spring contact strip 2 and, in the area of housing connector surface 2*a*, are positioned at opposite sides from each other to include an upward crimp area which contains a plurality of side bar 9' which is separated by a space or gap "Sp". It is especially through the last mentioned characteristic that a good electrical ground contact between shielding surfaces 7 and 8 and the connector plug 9 is established. The plug 9, as illustrated on the front and backside, can include any number and size of side bars 9' and spaces "Sp" as may be desired.

As seen in the drawing, the preferred design for the shielding device includes the possibility of ground guide 7 being equipped with soldering contact 7*c* leading to the backside 4*a* of daughter board 4 instead of the offset 7*a*. Additionally, it would be possible to raise up and/or extend the shielding hood 8, as shown at extension 8', over the entire daughter board 4 rather than being curved back to intersect the daughter board 4 adjacent the pins 5.

In order to connect the printed circuitry of the mother board 3 with the daughter board 4, standard connector portions 1 and 2 are utilized. The standard connector portion 1 includes an insulated housing for the receipt of contacts 5 therein. The housing of portion 1 includes side portions which extend downwardly to a lower surface 1*a*. The contacts 5 include pin portions 5*b* which are oriented to extend generally parallel to the daughter board 4. Additionally, the contacts 5 include the terminal ends 5*a* which are bent to be perpendicular to and to extend through the daughter board 4 for making electrical contact with the other side 4*a* thereof.

The other connector portion 2 includes spring contacts 6 which are adapted to mate with the pin portions 5*b*. The spring contacts 6 are oriented to extend generally perpendicularly to the mother board 3. The spring contacts 6 are also installed within an insulated housing and include the lower portions 6*a* thereof which extend through the mother board 3 for electrical contact with the other side 3*a* thereof. As a result of the preferred orientation of the connectors 1 and 2, the daughter board 4 will extend generally perpendicular to the mother board 3 when the connector portions 1 and 2 are mated to electrically connect the pin portions 5*b* and spring contacts 6.

As seen in the drawing the electrical connector portion 1 is not fully installed on the connector portion 2. The distance therebetween is indicated by the distance "A". As a result, the pins 5*b* are not received in or making electrical contact with the spring contacts 6. Once the electrical connector portion 1 is fully installed on the electrical connector portion 2, electrical current can pass between each of the contacts 5 and its corresponding mating portion spring contact 6. As mentioned above, it has been found that it is possible for the current passing through such contacts to produce interfering signals for the other components of either of the mother board 3 or the daughter board 4. Similarly, interfering electrical radiation or signals from the environment can prevent proper electrical conduction of signals or the like through the contacts 5 and 6.

As a result, the preferred shielding device is employed to prevent radiation which would interfere with current passing through the connector and would prevent interfering signals from being generated from the connector to other components of the circuit boards. The preferred shielding configuration employs similar shielding devices 9 at both sides of the connector portion 2 and differently configured shielding devices 7 and 8 at both sides of the electrical connector portion 1. Basically, the combined shielding devices 7, 8 and 9 are intended to encircle and surround the connector portions 1 and 2 to prevent the undesired radiation and interference as discussed hereinabove. Accordingly, the shielding device 7 is closely received against the outer surface of the insulation of the housing of the connector portion 1 while the shielding device 8 is closely received against the outer surface of the insulation of the housing of the connector portion 1 at the other side thereof. Similarly, the shielding devices 9 are closely received at the outer surfaces of the insulation of the housing of the electrical connector portion 2.

Although the shielding devices 7, 8 and 9 are closely received about the outer surface of their respective connector portions, none of the shielding devices are located at the mating surfaces 1*a* and 2*a* of the connector portions after the connector portions 1 and 2 are fully mated. Once the connector portions 1 and 2 are fully mated or installed, the configuration of the shielding device 9 insures that there is an overlapping of the shielding device 7 with one of the shielding devices 9 and an overlapping of the shielding device 8 with the other of the shielding devices 9. Accordingly, the electrical connector portion 1 with the shielding devices 7 and 8 thereon will be moved through the distance "A" toward the connector portion 2 with the overlapping of the shielding devices 7 and 8 with their respective shielding devices 9.

To insure positive electrical contact between the shielding devices as they overlap, the devices 7 and 8 are mounted at and in contact with the outer surfaces. On the other hand, the shielding devices 9 are made of a resilient, spring-like metal with an L-shaped cross section. With the fold 9*b* forming one leg and being fixed between the base of the housing and the mother board 3, the other leg extends generally along and parallel with the adjacent outer surface. The other leg is biased toward the outer surface and is maintained at the predetermined distance "a" from the outer surface by the crimp 10 for the receipt of the lower portion of the housing of the connector portion 1. The extended edge of the side bar 9' is flaired outwardly for sliding contact with the shielding device at the outer surface of the connector portion 1 so that the shielding device tends to cam the side bar 9' outwardly against biasing to produce a positive electrical contact. Such a configuration ensures positive shielding of the connector portions 1 and 2, and the contacts therein, when they are properly joined.

It should be noted that the alternative configuration for the shielding devices 7 and 8 nevertheless ensures proper shielding for the contacts 5 of the connector portion 1. For example, if the shielding device 7 extends upwardly with a portion 7*c*, the shielding effect would generally be comparable to that of the offset portion 7*b*. Also, if the shielding device 8 were to extend upwardly with an extension 8' rather than a bend 8*a*, there would nevertheless be proper shielding for the contacts 5 therein. With the shielding device 8 extending beyond the portion shown in the drawing for 8', it should be recognized that an extended portion of the shielding extension 8' could again be directed back toward the daughter board 4 for providing an electrical contact therewith.

In summary, one aspect of the invention can include the shielding of plug connections consisting of standard terminal strip 1 and spring contact strip 2, especially the so called "indirect plug connection". For example, such connections can be used to connect a daughter board 4 to a mother board which serves as a printed circuit board 3 with a printed circuit. The shielding is characterized by the following features:

a. Surfaces of the insulation housing, if required, of terminal strip 1, including all exposed parts of the electric contact pins 5, and of spring terminal strip 2, which are located on the surface of the circuit boards 3 and 4, are, with the exception of the area of contact 1*a* and 2*b*, preferably covered on all sides with a metallic or otherwise conductive shielding devices 7, 8 and 9.

b. Ground contacts 7*b* or 7*c*, 8*b* and 9*c* are respectively attached to shielding devices 7, 8 and 9 and can be attached to the backside of corresponding printed circuit boards 3*a* and 4*a* by either a soldering or a plug-type contact.

Additionally, the inventions can include the shielding characterized by the fact that shielding devices are developed as separate metallic folded profiles in the shape of ledges 7 and 9, respectively, with an offset 7*a* and a fold 9*b* and a hoodshaped device 8, 8*a*.

The shielding may be characterized by the fact that shielding devices 7, 7*a* and 8 are touching on the side surfaces of the insulation housing of the terminal strip 1 in the area of contact surface 1*a*. The shielding devices 9, 9*b* are attached to spring contact strip 2 by means of a spring travel limitation crimp 10 or the like at a plug-in distance (a) from the surface of the housing of the spring contact strip 2.

The shielding may also be characterized by the fact that ledge-like shielding metals 9 with a fold 9*b* extend in part under the housing of the spring contact strip 2 and are in reciprocal distance "Sp" in the area of the housing contact surface 2*a* with an upward bend 9*a* and a crimp at side bar 9'.

It should be clear to those skilled in the connector art that various alterations of the preferred embodiment could be provided without departing from the scope of the invention as claimed. For example, the overall, biased and overlapping configuration by one of the shielding devices 9 could be employed on the other connector portion or even at only one of the opposite sides of each of the mating connector portions. The preferred configuration is appropriate because of the manner in which parts of the housings of the connector portions 1 and 2 overlap. However, another form of mating of the housings could result in a modification of the respective shielding devices to nevertheless produce a desired overlapping configuration for insuring positive, shielding contact between the shielding devices.

All of the patents, patent applications, and publications recited herein, if any, are hereby incorporated by reference as if set forth in their entirety herein.

The invention as described hereinabove in the context of a preferred embodiment is not to be taken as limited to all of the provided details thereof, since modifications and variations thereof may be made without departing from the spirit and scope of the invention.

What is claimed is:

1. Shielded connector for connecting a first board to a second board, such as printed circuit boards, said shielded connector comprising;

a first connector housing;

said first connector housing for being installed on the first board:

said first connector housing including first electrical contacts therein which are for being electrically connected to the first board;

a second connector housing;

said second connector housing for being installed on the second board;

said second connector housing including second electric contacts therein which are for being electrically connected to the second board;

said first connector housing being for mating with said second connector housing for causing said first electric contacts to mate with said second electric contacts;

first means for shielding said first electrical connector housing and said first electric contacts therein:

said first means for shielding including a first shielding device at one side of said first connector housing and a second shielding device at the other side of said first connector housing;

said first shielding device and said second shielding device being respectively electrically connected to the first board;

a second means for shielding said second connector housing and said second electric contacts therein;

said second means for shielding including a third shielding device at one side of said second connector housing and a fourth shielding device at the other side of said second connector housing;

said third shielding device and said fourth shielding device being respectively electrically connected to the second board; and said first shielding device for being in overlapping electrical contact with said third shielding device and said second shielding device for being in overlapping electrical contact with said fourth shielding device when said first connector housing and said second connector housing are mated for causing said first electric contacts to mate with said second electric contacts.

2. The shielded connector according to claim 1, wherein said first shielding device and said second shielding device are respectively mounted at and in contact with an outer surface of said one side and an outer surface of said other side of said first connector housing.

3. The shielded connector according to claim 2, wherein at least one of said first shielding device and said second shielding device extends beyond said outer surface toward said first board to cause any exposed parts of said first electric contacts to be disposed within said first means for shielding.

4. The shielded connector according to claim 3, wherein said at least one of said first shielding device and said second shielding device is hoodshaped to have an L-shaped profile having one edge portion and an opposite edge portion, said one edge portion of said L-shaped profile is in contact with said outer surface of said first connector housing, and said opposite edge portion of said L-shaped profile is disposed at and in contact with said first board.

5. The shielded connector according to claim 3, wherein said at least one of said first shielding device and said second shielding device includes an offset profile, said offset profile has one edge portion and an opposite edge portion, said one edge portion of said offset profile is in contact with said outer surface of said first connector housing, and said opposite edge portion of said offset profile is disposed at and in contact with said first board.

6. The shielded connector according to claim 1, wherein said third shielding device and said fourth shielding device are respectively mounted at an outer surface of said one side and an outer surface of said other side of said second connector housing.

7. The shielded connector according to claim 6, wherein at least one of said third shielding device and fourth shielding device has an L-shaped cross section, said second connector housing includes a base, said second connector housing is generally installed on said second board with said base of said second connector housing toward a surface of said second board, said L-shaped cross section includes a first leg portion and a second leg portion, said first leg portion extends along said outer surface of said second connector housing, and said second leg portion extends between said base of said second connector housing and said surface of second board.

8. The shielded connector according to claim 7, wherein said first leg portion of said L-shaped cross section is generally parallel with said outer surface of said second connector housing and spaced therefrom.

9. The shielded connector according to claim 8, wherein said first leg portion of said L-shaped cross section is generally biased toward said outer surface of said second connector housing and further including means for maintaining said first leg portion of said L-shaped cross section generally spaced from said outer surface against said biasing.

10. The shielded connector according to claim 9, wherein said means for maintaining includes a travel limiting crimped portion extending from said first leg portion of said L-shaped cross section toward said outer surface of said second connector housing for making contact with said outer surface of said second connector housing.

11. The shielded connector according to claim 10, wherein said first shielding device and said second shielding device are respectively mounted at and in contact with an outer surface of said one side and an outer surface of said other side of said first connector housing.

12. The shielded connector according to claim 11, wherein at least one of said first shielding device and said second shielding device and a corresponding adjacent portion of said first connector housing extend between said first leg portion of said L-shaped cross section of a corresponding one of said third shielding device and said fourth shielding device and said outer surface of said second connector housing adjacent to said first leg portion to produce said overlapping electrical contact by said biasing of said first leg portion toward said at least one of said first shielding device and said second shielding device.

* * * * *